US008863970B2

(12) United States Patent
Hunter

(10) Patent No.: US 8,863,970 B2
(45) Date of Patent: Oct. 21, 2014

(54) PLASTIC CONTAINER WITH ANTI-BULGE PANEL

(75) Inventor: Travis A. Hunter, Hellam, PA (US)

(73) Assignee: Graham Packaging Company, L.P., York, OH (US)

( * ) Notice: Subject to any disclaimer, the term of this patent is extended or adjusted under 35 U.S.C. 154(b) by 345 days.

(21) Appl. No.: 13/115,527

(22) Filed: May 25, 2011

(65) Prior Publication Data

US 2012/0298541 A1 Nov. 29, 2012

(51) Int. Cl.
*B65D 1/44* (2006.01)
*B65D 1/02* (2006.01)

(52) U.S. Cl.
CPC ..... *B65D 1/0223* (2013.01); *B65D 2501/0081* (2013.01); *B65D 2501/0036* (2013.01); *B65D 1/44* (2013.01)
USPC ..... 215/382; 220/675; 40/310

(58) Field of Classification Search
USPC ..... 215/381, 382, 384, 383, 365; 220/666, 220/669, 672, 675; 206/459.5; 40/310
See application file for complete search history.

(56) References Cited

U.S. PATENT DOCUMENTS

| | | | | |
|---|---|---|---|---|
| 4,805,788 | A | 2/1989 | Akiho | |
| 4,818,575 | A | 4/1989 | Hirata et al. | |
| 4,946,053 | A | 8/1990 | Conrad | |
| 5,067,622 | A | 11/1991 | Garver et al. | |
| 5,178,290 | A | 1/1993 | Ota et al. | |
| 5,199,588 | A | 4/1993 | Hayashi | |
| 5,222,615 | A | 6/1993 | Ota et al. | |
| 5,238,129 | A | 8/1993 | Ota | |
| D347,391 | S | 5/1994 | Guertin | |
| 5,310,068 | A | 5/1994 | Saghri | |
| 5,337,909 | A * | 8/1994 | Vailliencourt | 215/381 |
| 5,350,078 | A * | 9/1994 | Potts et al. | 215/384 |
| 5,606,453 | A * | 2/1997 | Walling et al. | 359/330 |
| 5,704,503 | A * | 1/1998 | Krishnakumar et al. | 215/381 |
| D412,119 | S | 7/1999 | Guertin | |
| 6,036,037 | A * | 3/2000 | Scheffer et al. | 215/381 |
| D452,444 | S | 12/2001 | Iizuka et al. | |
| 6,575,321 | B2 * | 6/2003 | Bourque et al. | 215/384 |
| D507,746 | S | 7/2005 | Sasaki et al. | |
| 6,974,047 | B2 * | 12/2005 | Kelley et al. | 215/381 |
| D527,266 | S | 8/2006 | Yourist et al. | |
| D528,427 | S | 9/2006 | Sasaki et al. | |
| D533,071 | S | 12/2006 | Forget | |
| D533,786 | S | 12/2006 | Ogg et al. | |
| D534,429 | S | 1/2007 | Yourist et al. | |
| D568,167 | S | 5/2008 | Sasaki et al. | |
| D568,169 | S | 5/2008 | Sasaki et al. | |
| D574,715 | S | 8/2008 | Sasaki et al. | |

(Continued)

*Primary Examiner* — Sue A Weaver
(74) *Attorney, Agent, or Firm* — Baker Botts L.L.P.

(57) ABSTRACT

A plastic container includes a finish portion defining an opening and a main body portion having a shape that is substantially polygonal in transverse cross-section. The main body portion has a maximum lateral dimension. At least one of the side panels includes a substantially flat portion for receiving a label and a concave portion having an average radius. A ratio of the average radius to the maximum lateral dimension is substantially within a range of about 1.0 to about 2.0. The side panel having the concave portion further has an inwardmost portion and an outwardmost portion, with a first maximum lateral distance being defined between the inwardmost portion and the outwardmost portion. A second maximum lateral distance is defined between the inwardmost portion and one of the substantially flat portions. A ratio of the first distance to the second distance is substantially within a range of about 0.8 to about 1.2.

20 Claims, 5 Drawing Sheets

(56) References Cited

U.S. PATENT DOCUMENTS

| | | | | |
|---|---|---|---|---|
| D577,594 | S | 9/2008 | Sasaki et al. | |
| D578,400 | S | 10/2008 | Sasaki et al. | |
| 7,455,189 | B2 | 11/2008 | Lane et al. | |
| D582,284 | S | 12/2008 | Ogg | |
| 7,458,478 | B2 * | 12/2008 | Kamineni | 215/381 |
| D598,774 | S | 8/2009 | Schlies et al. | |
| D598,782 | S | 8/2009 | Sasaki et al. | |
| 7,857,157 | B2 | 12/2010 | Lane et al. | |
| D631,748 | S | 2/2011 | Kojitani et al. | |
| 8,109,398 | B2 * | 2/2012 | Lewis et al. | 215/384 |
| 2004/0164046 | A1 * | 8/2004 | Kelley | 215/382 |
| 2006/0151425 | A1 * | 7/2006 | Kelley et al. | 215/381 |
| 2007/0045222 | A1 | 3/2007 | Denner et al. | |
| 2007/0170144 | A1 | 7/2007 | Lane et al. | |
| 2009/0266786 | A1 * | 10/2009 | Sasaki | 215/384 |
| 2009/0294400 | A1 * | 12/2009 | Sasaki et al. | 215/382 |
| 2010/0006535 | A1 | 1/2010 | Ogg | |
| 2010/0326950 | A1 * | 12/2010 | Lane | 215/381 |
| 2011/0073559 | A1 * | 3/2011 | Schlies et al. | 215/381 |

* cited by examiner

PLASTIC CONTAINER WITH ANTI-BULGE PANEL

BACKGROUND OF THE INVENTION

1. Field of the Invention

This invention relates generally to the field of packaging, and more specifically to the field of blow molded plastic containers for packaging substances such as beverages.

2. Description of the Related Technology

Many products that were previously packaged using glass containers are now being supplied in plastic containers. Polyethylene terephthalate (PET) thermoplastic resins are polyester materials that provide clarity and transparency that is comparable to glass. PET possesses the processing characteristics, chemical and solvent resistance and high strength and impact resistance that are required for packaging products such as juices, soft drinks and water. PET containers are lightweight, inexpensive, and recyclable and can be economically manufactured in large quantities. They will not shatter and create potentially dangerous shards when dropped, as glass containers may.

PET containers have conventionally been manufactured using the stretch blow molding process. This involves the use of a pre-molded PET preform having a threaded portion and a closed distal end. The preform is first heated and then is longitudinally stretched and subsequently inflated within a mold cavity so that it assumes the desired final shape of the container. As the preform is inflated, it elongates and stretches, taking on the shape of the mold cavity. The polymer solidifies upon contacting the cooler surface of the mold, and the finished hollow container is subsequently ejected from the mold.

In order to minimize materials costs, a plastic container should ideally be constructed to use as little plastic resin as possible. Such lightweighting is usually accomplished by making the sidewall of the container as thin as possible, but this adversely impacts the strength and rigidity of the sidewall. In larger plastic beverage containers, such as those having a volumetric capacity of 64 ounces or greater, outward bulging of the sidewall as result of the hydrostatic pressure exerted by the liquid within the container can be problematic, particularly in containers that are noncircular in transverse cross-section.

A need has existed for an improved noncircular plastic container that possesses improved resistance to outward bulging of the sidewall with respect to conventional containers, without having a significant negative impact on material costs.

SUMMARY OF THE INVENTION

Accordingly, it is an object of the invention to provide an improved noncircular plastic container that possesses improved resistance to outward bulging of the sidewall with respect to conventional containers, without having a significant negative impact on material costs.

In order to achieve the above and other objects of the invention, a plastic container according to a first aspect of the invention includes a finish portion defining an opening and a main body portion having a shape that is substantially polygonal in transverse cross-section with a plurality of side panels. The main body portion has a maximum lateral dimension. At least one of the side panels includes a substantially flat portion for receiving a label and a concave portion having an average radius. A ratio of the average radius to the maximum lateral dimension is substantially within a range of about 1.0 to about 2.0.

A plastic container according to a second aspect of the invention includes a finish portion defining an opening, and a main body portion having a shape that is substantially polygonal in transverse cross-section with a plurality of side panels. The main body portion has a maximum lateral dimension. At least one of the side panels includes a first upper substantially flat portion for receiving a label, a second, lower substantially flat portion for receiving a label and a central concave portion positioned between the first and second substantially flat portions.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
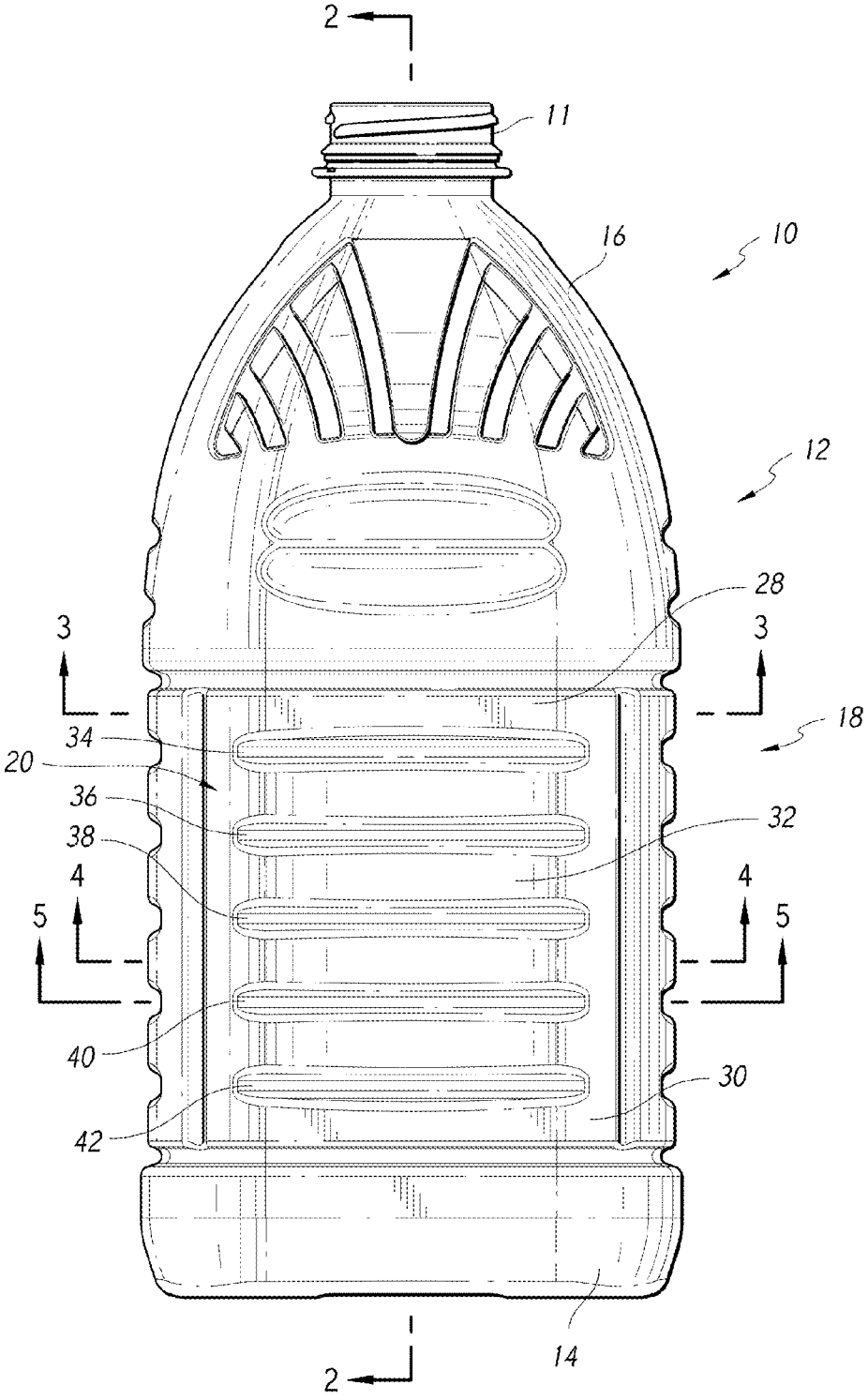
FIG. 1 is a front elevational view of a plastic container that is constructed according to a preferred embodiment of the invention.

Referring now to the drawings, wherein like reference numerals designate corresponding structure throughout the views, and referring in particular to FIG. 1, a plastic container 10 that is constructed according to a preferred embodiment of the invention is preferably fabricated from a plastic material such as polyethylene terephthalate (PET) using a conventional stretch blow molding process. Plastic container 10 preferably has an internal volume that is at least 64 ounces, and that is more preferably at least 80 ounces.

Figure 3:
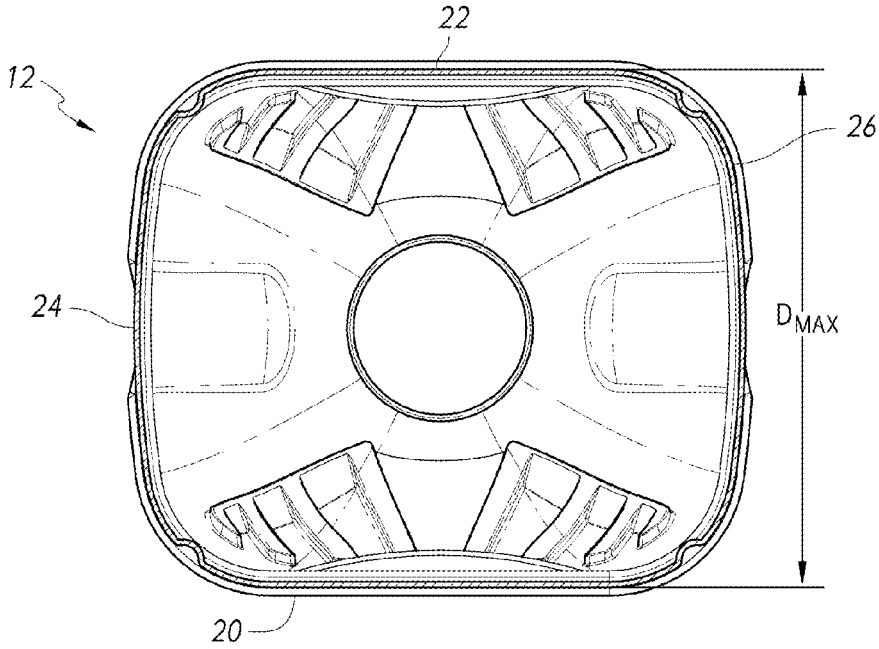
FIG. 3 is a cross-sectional view taken along lines 3-3 in FIG. 1.
Figure 4:
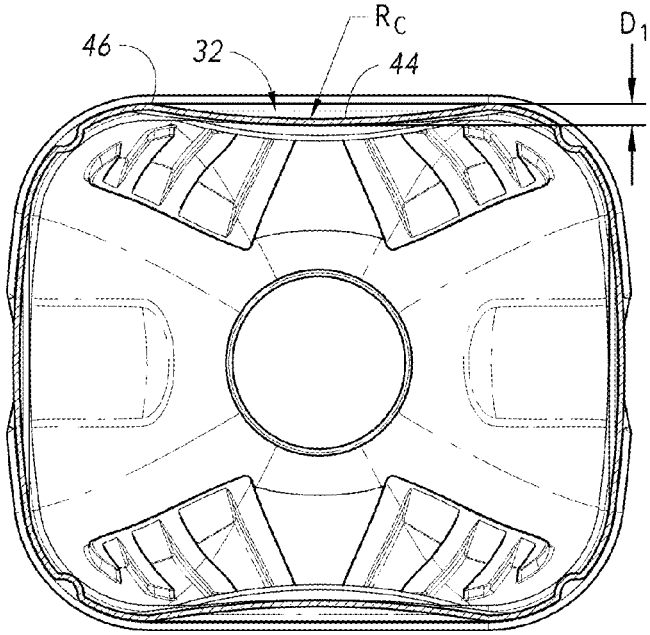
FIG. 4 is a cross-sectional view taken along lines 4-4 in FIG. 1.
Figure 5:
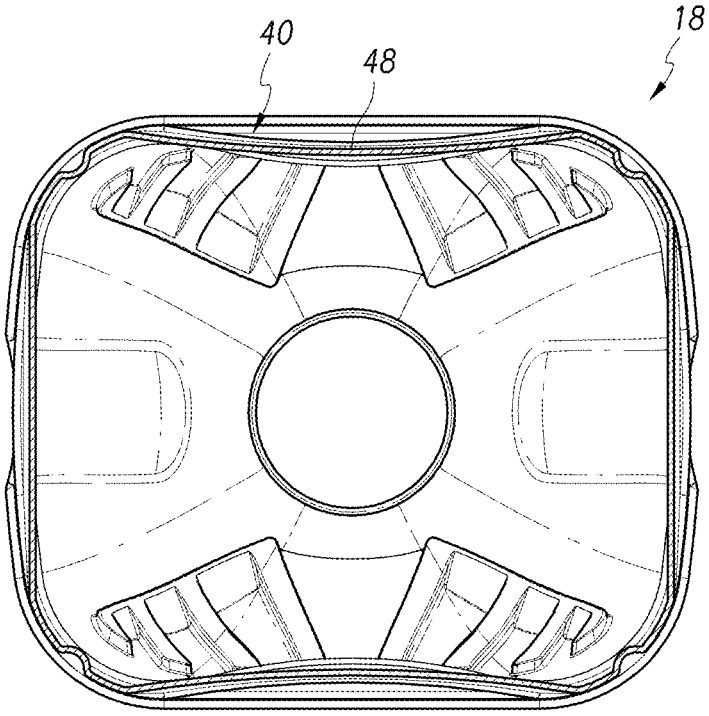
FIG. 5 is a cross-sectional view taken along lines 5-5 in FIG. 1.

Referring to FIG. 1, plastic container 10 preferably includes a threaded finish portion 11, a main body portion 12 and a bottom portion 14 that is unitary with the main body portion 12. The main body portion 12 includes an upper dome portion 16 and a label portion 18 which is substantially polygonal when viewed in transverse cross-section. As FIGS. 3-5 show, the label portion 18 of the main body portion 12 in the preferred embodiment is substantially rectangular in transverse cross-section.

Figure 2:
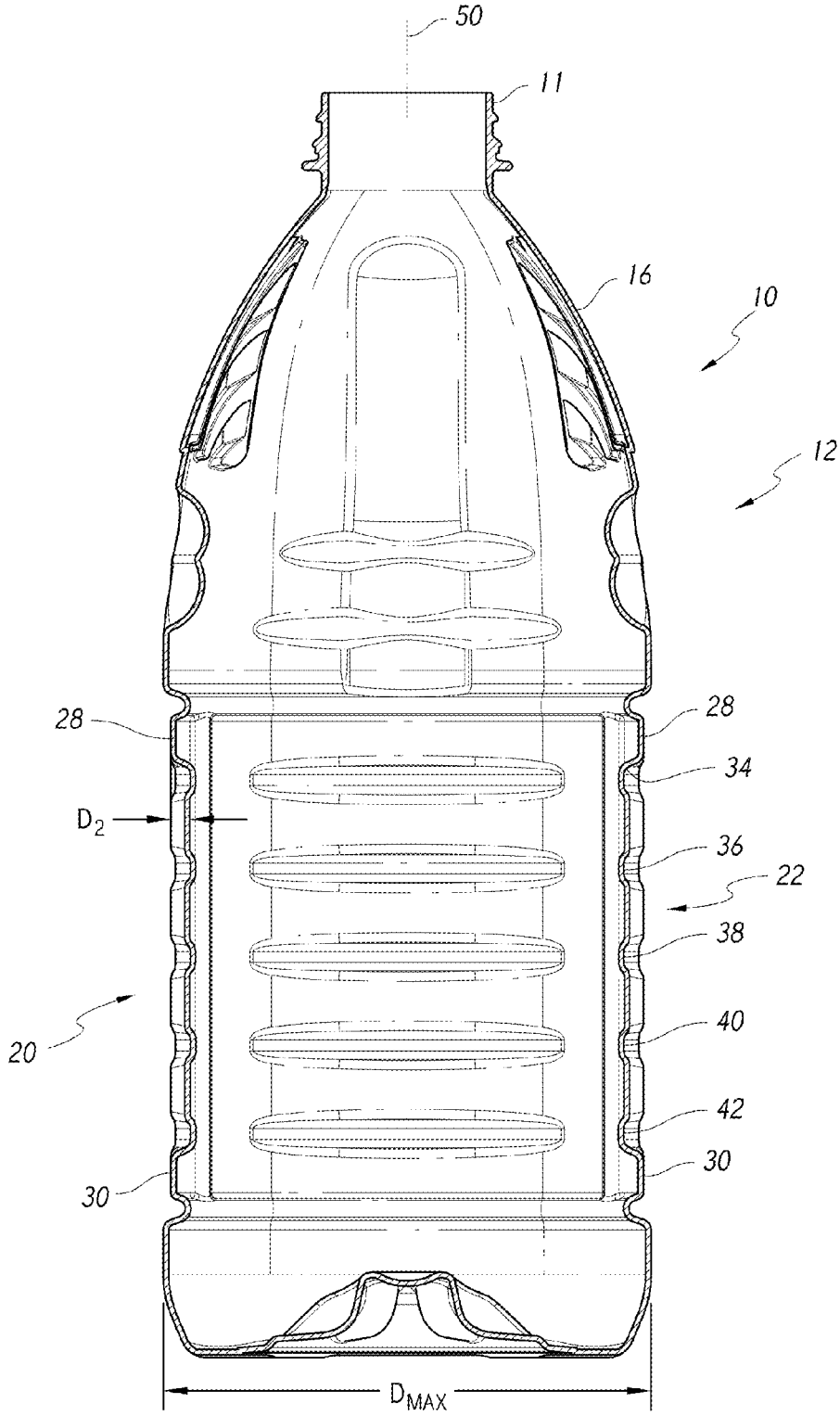
FIG. 2 is a cross-sectional view taken along lines 2-2 in FIG. 1.

Label portion 18 includes a plurality of side panels 20, 22, 24, 26, including front and rear side panels 20, 22. At least one of the side panels 20, 22, 24, 26 includes at least one substantially flat portion 28, 30 for receiving a label and a concave portion 32 having an average radius $R_C$. The main body portion 12 has a maximum lateral dimension $D_{MAX}$, which is best shown in FIG. 2. A ratio $R_C/D_{MAX}$ of the average radius $R_C$ to the maximum lateral dimension $D_{MAX}$ is preferably substantially within a range of about 1.0 to about 2.0, more preferably substantially within a range of about 1.1 to about 1.9 and most preferably substantially within a range of about 1.2 to about 1.8.

In the preferred embodiment, the average radius $R_C$ is substantially unchanged when viewed in transverse cross-section from an upper portion of the concave portion 32 to a lower portion of the concave portion 32.

In the preferred embodiment, the front and rear side panels 20, 22 each have a first, upper substantially flat portion 28 near an upper end of the respective panel 20, 22 for receiving a first portion of a label and a second, lower substantially flat portion 30 near a lower end of the respective panel 20, 22 for receiving another portion of the label. A central, concave portion 32 is positioned between the upper and lower substantially flat portions 28, 30.

A plurality of reinforcing ribs 34, 36, 38, 40, 42 are preferably defined in each of the front and rear side panels 20, 22. The reinforcing ribs 34, 36, 38, 40, 42 in the preferred embodiment have a substantially horizontal orientation.

Each of the side panels 20, 22 that have the concave portion 32 has an inwardmost portion 44 and an outwardmost portion 46, as FIG. 4 best shows. The outwardmost portion 46 preferably extends laterally outwardly from a central longitudinal axis 50 to substantially the same extent as the substantially flat portion 28. As FIG. 4 shows, a first maximum lateral distance $D_1$ is defined between the inwardmost portion 44 and the outwardmost portion 46. A second maximum lateral distance $D_2$ is defined between the inwardmost portion 44 and the substantially flat portion 28, as FIG. 2 shows.

A ratio $D_1/D_2$ of the first distance $D_1$ to the second distance $D_2$ is preferably substantially within a range of about 0.8 to about 1.2 and more preferably substantially within a range of about 0.9 to about 1.1.

Reinforcing rib 34 defines a boundary between the first, upper substantially flat portion 28 and the central concave portion 32, and reinforcing rib 42 defines a boundary between the second, lower substantially flat portion 30 and the central concave portion 32. In other words, the portion of the side panel 20, 22 above the reinforcing rib 34 is preferably substantially flat, while the portion of the side panel 20, 22 below the reinforcing rib 34 is preferably concave. Likewise, the portion of the side panel 20, 22 below the reinforcing rib 42 is preferably substantially flat, while the portion of the side panel 20, 22 above the reinforcing rib 42 is preferably concave.

Figure 6:
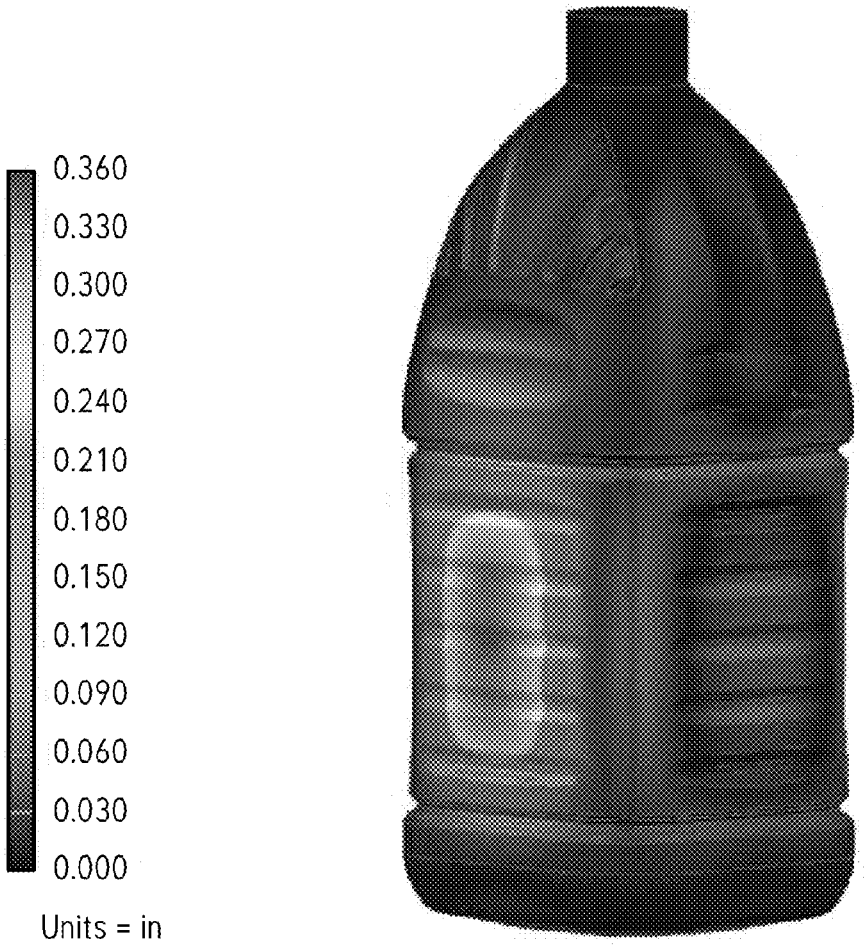
FIG. 6 is a finite element analysis (FEA) display indicating flexure of the container that is shown in FIG. 1.

FIG. 6 is a finite element analysis (FEA) display indicating flexure of the container between the filled and unfilled states. It shows that the central concave portion 32 of the side panel 20, 22 is permitted to flex, while the upper and lower substantially flat portions 28, 30 substantially retain their shape. This facilitates adhesion of a label to the container 10.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A plastic container, comprising:

a finish portion defining an opening; and a main body portion having a shape that is substantially polygonal in plan view with a plurality of side panels, the main body portion having a maximum lateral dimension between a front side panel and a rear side panel, and wherein at least one of the side panels includes a substantially flat portion for receiving a label and an outwardly-facing concave portion defined by an average radius in plan view, and further wherein a ratio of the average radius to the maximum lateral dimension is substantially within a range of about 1.0 to about 2.0.

2. A plastic container according to claim 1, wherein the ratio of the average radius to the maximum lateral dimension is substantially within a range of about 1.1 to about 1.9.

3. A plastic container according to claim 2, wherein the ratio of the average radius to the maximum lateral dimension is substantially within a range of that 1.2 to about 1.8.

4. A plastic container according to claim 1, wherein the main body portion is substantially rectangular in plan view, and wherein a second of the side panels has a substantially flat portion for receiving a label and a concave portion defined by an average radius in plan view.

5. A plastic container according to claim 1, wherein the substantially flat portion of the at least one of the side panels has a first substantially flat portion near an upper end of the panel for receiving a label and a second substantially flat portion near a lower end of the panel for receiving the label.

6. A plastic container according to claim 1, wherein a reinforcing rib is defined in the side panel between the substantially flat portion and the concave portion.

7. A plastic container according to claim 6, wherein the reinforcing rib has a substantially horizontal orientation.

8. A plastic container according to claim 6, wherein the reinforcing rib defines a boundary between the substantially flat portion and the concave portion.

9. A plastic container according to claim 1, further comprising a plurality of reinforcing ribs defined in the side panel.

10. A plastic container according to claim 1, wherein the plastic container has a volume that is at least 64 ounces.

11. A plastic container according to claim 1, wherein the concave portion extends inwardly from the at least one side panel, the at least one side panel having an inwardmost portion and an outwardmost portion, wherein the outwardmost portion extends laterally outwardly from a central longitudinal axis to substantially the same extent as the substantially flat portion.

12. A plastic container according to claim 1, wherein the concave portion extends inwardly from the at least one side panel, the at least one side panel having an inwardmost portion and an outwardmost portion, with a first maximum lateral distance being defined between the inwardmost portion and the outwardmost portion and a second maximum lateral distance being defined between the inwardmost portion and the substantially flat portion, and wherein a ratio of the first distance to the second distance is substantially within a range of about 0.8 to about 1.2.

13. A plastic container according to claim 12, wherein the ratio of the first maximum lateral distance to the second maximum lateral distance is substantially within a range of about 0.9 to about 1.1.

14. A plastic container according to claim 1, wherein the main body portion is substantially symmetric about a plane that intersects a longitudinal axis of the container.

15. A plastic container, comprising:

a finish portion defining an opening; and a main body portion having a shape that is substantially polygonal in plan view with a plurality of side panels, the main body portion having a maximum lateral dimension between a front side panel and a rear side panel and wherein at least one of the side panels defines an outer perimeter and includes an upper substantially flat portion along a top edge of the perimeter for receiving a label, a lower substantially flat portion along a bottom edge of the perimeter for receiving a label and an outwardly-facing concave portion defined by an average radius in plan view positioned between the first and second substantially flat portions, wherein a ratio of the average radius to the maximum lateral dimension is substantially within a range of about 1.0 to about 2.0.

16. A plastic container according to claim 15, further comprising a rib defined between the concave portion and the first upper substantially flat portion.

17. A plastic container according to claim 16, wherein the rib has a substantially horizontal orientation.

18. A plastic container according to claim 16, further comprising a second rib defined between the concave portion and the lower substantially flat portion.

19. A plastic container according to claim 15, wherein the concave portion extends inwardly from the at least one side panel, the at least one side panel having an inwardmost portion and an outwardmost portion, with a first maximum lateral distance being defined between the inwardmost portion and the outwardmost portion and a second maximum lateral distance being defined between the inwardmost portion and one of the substantially flat portions, and wherein a ratio of the first distance to the second distance is substantially within a range of about 0.8 to about 1.2.

20. A plastic container according to claim 19, wherein the ratio of the first distance to the second distance is substantially within a range of about 0.9 to about 1.1.

* * * * *